US008474958B2

(12) United States Patent
Kuwata et al.

(10) Patent No.: US 8,474,958 B2
(45) Date of Patent: Jul. 2, 2013

(54) INK CARTRIDGE AND IMAGE FORMING APPARATUS INCLUDING THE SAME

(75) Inventors: Masahiro Kuwata, Kanagawa (JP); Tadashi Hayakawa, Kanagawa (JP); Ikoh Soh, Kanagawa (JP); Tomomi Katoh, Kanagawa (JP); Toshiroh Tokuno, Tokyo (JP); Akiko Bannai, Kanagawa (JP); Shotaro Takeuchi, Kanagawa (JP); Masanori Kusunoki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 371 days.

(21) Appl. No.: 12/874,775

(22) Filed: Sep. 2, 2010

(65) Prior Publication Data

US 2011/0063382 A1 Mar. 17, 2011

(30) Foreign Application Priority Data

Sep. 14, 2009 (JP) ..... 2009-211357

(51) Int. Cl.
*B41J 2/175* (2006.01)

(52) U.S. Cl.
USPC ..... 347/86

(58) Field of Classification Search
USPC ..... 347/7, 85, 86; 399/262
See application file for complete search history.

(56) References Cited

U.S. PATENT DOCUMENTS

| | | | | |
|---|---|---|---|---|
| 5,359,356 | A * | 10/1994 | Ecklund | 347/86 |
| 5,631,681 | A * | 5/1997 | Klaus et al. | 347/85 |
| 6,010,211 | A * | 1/2000 | Betschon | 347/86 |
| 6,948,803 | B2 * | 9/2005 | Yoshida et al. | 347/85 |
| 7,065,313 | B2 * | 6/2006 | Matsumoto et al. | 399/262 |
| 7,121,655 | B2 * | 10/2006 | Silverbrook | 347/86 |
| 7,245,853 | B2 * | 7/2007 | Muramatsu et al. | 399/120 |
| 7,325,908 | B2 | 2/2008 | Katoh et al. | |
| 7,931,357 | B2 * | 4/2011 | Umeda | 347/85 |
| 2008/0219683 | A1 | 9/2008 | Muramatsu | |
| 2008/0219687 | A1 * | 9/2008 | Shinichi | 399/60 |
| 2009/0256892 | A1 | 10/2009 | Takeuchi | |
| 2010/0020142 | A1 | 1/2010 | Bannai et al. | |

FOREIGN PATENT DOCUMENTS

| | | |
|---|---|---|
| CN | 1672928 A | 9/2005 |
| JP | 2006-281588 | 10/2006 |
| JP | 2006-327111 | 12/2006 |
| JP | 2008-134591 | 6/2008 |

OTHER PUBLICATIONS

Chinese official action dated Dec. 28, 2012 in connection with corresponding Chinese patent application No. 201010284081.4.

* cited by examiner

*Primary Examiner* — Anh T. N. Vo
(74) *Attorney, Agent, or Firm* — Cooper & Dunham LLP

(57) ABSTRACT

An ink cartridge includes a flexible container containing ink; and a restriction mechanism allowing the flexible container to deform only in the direction to decrease the volume of the flexible container. The ink cartridge is used for an image forming apparatus including an inkjet head for jetting ink from nozzles.

9 Claims, 9 Drawing Sheets

INK CARTRIDGE AND IMAGE FORMING APPARATUS INCLUDING THE SAME

BACKGROUND OF THE INVENTION

1. Field of the Invention

A certain aspect of the present invention relates to an ink cartridge and an image forming apparatus including the ink cartridge.

2. Description of the Related Art

There are image forming apparatuses (e.g., a printer, a fax machine, a copier, and a multifunction peripheral) that use a liquid-jet device to form (record or print) an image on paper (not limited to a sheet of paper but also refers to any medium on which an image can be formed, and may also be called a recording medium, recording paper, recording sheet, recording material, etc.). The liquid-jet device includes a liquid-jet head (inkjet head) as a recording head and jets a recording liquid (or ink) from the liquid-jet head onto paper being conveyed in the image forming apparatus to form an image on the paper.

In the present application, an image forming apparatus refers to an apparatus that forms an image by jetting a liquid onto a recording medium made of paper, thread, fabric, silk, leather, metal, plastic, glass, wood, ceramic, etc. Also, "image forming" indicates not only a process of forming a meaningful image such as a character or a figure on a recording medium, but also a process of forming a meaningless image such as a pattern on a recording medium. A "liquid" is not limited to a recording liquid or ink and may refer to any type of liquid capable of forming an image. Further, a liquid-jet device refers to any device that jets a liquid from its liquid-jet head.

One type of image forming apparatus employing a liquid-jet device includes a main ink cartridge (main tank or primary liquid container) with a large capacity and a head tank (sub tank or secondary liquid container) with a small capacity. The main ink cartridge is mounted on the body of the image forming apparatus and supplies ink to the head tank that is mounted on a carriage and supplies ink to a recording head. In another type of image forming apparatus, an ink cartridge used as a replaceable liquid container is mounted on a carriage together with a recording head (see, for example, Japanese Patent Application Publication No. 2006-327111 (JP2006-327111)).

Generally, an ink cartridge includes a flexible container for containing ink. Such a flexible container deforms as the contained ink is consumed and as a result, the volume of the flexible container decreases. However, the flexible container does not deform in such a manner that two opposing sides of the flexible container are kept parallel to each other and just the distance between them is decreased. Instead, the two opposing sides are unevenly deformed due to local pressures of the contained liquid. Such uneven deformation of the flexible container results in unusable ink that cannot be drawn from the ink cartridge.

When an ink cartridge becomes empty, the ink cartridge is replaced with a new ink cartridge filled with ink to continue printing. For this purpose, it is necessary to report the amount of remaining ink to the user and to request the user to replace an empty ink cartridge with a new ink cartridge.

One method of detecting the amount of remaining ink is to calculate the volume of printing (e.g., the number of printed pages), estimate the amount of used ink based on the calculated volume of printing, and calculate the amount of remaining ink based on the estimated amount of used ink. However, because of evaporation of ink and use of ink for a maintenance process, the calculated amount of remaining ink may differ from the actual amount of remaining ink in the ink cartridge. Such a difference may cause an image forming apparatus to request the user to replace an ink cartridge even when ink remains in the ink cartridge or to continue printing even when the ink cartridge is empty.

In trying to solve the above problems, JP2006-327111 proposes a method of detecting the amount of remaining ink based on the capacitance between electrodes provided on a flexible container. JP2006-327111 also discloses reinforcing parts for keeping the electrodes parallel to each other. With this method, however, the two opposing sides of the flexible container are still unevenly deformed due to local pressures of the contained liquid and it becomes difficult to accurately detect the amount of remaining ink and to correctly determine the timing to replace the ink cartridge.

Meanwhile, an ink bag used as the flexible container of an ink cartridge typically has an ink outlet for supplying ink to a recording head. The ink outlet is, for example, implemented by a rubber plug having a through hole communicating with the inside of the ink bag. An ink supply needle of the image forming apparatus is inserted into the through hole.

Ink is drawn from the ink bag via the ink supply needle by, for example, suction force produced when ink is jetted from the recording head, suction force produced by a suction pump of the image forming apparatus, or the difference in pressure head between the ink cartridge mounted on the body of the image forming apparatus and the sub tank mounted on the carriage. When ink is drawn from the ink bag to the recording head, the pressure in the ink bag decreases according to the amount of ink drawn from the ink bag and becomes negative with respect to the atmospheric pressure. If the ink cartridge is removed from the image forming apparatus when the pressure in the ink bag is negative, external air and dust flow into the ink bag through the through hole as soon as the ink supply needle is pulled out of the through hole. Also, the volume of the ink bag of a partially-used ink cartridge is smaller than original since the amount of ink has been reduced. The ink bag of such a partially-used ink cartridge tends to move in the housing of the ink cartridge when detached from or attached to the image forming apparatus and the pressure in the ink bag changes greatly. This may also cause external air and dust to flow into the ink bag. The air and dust introduced into the ink in the ink bag may in turn degrade the inkjet performance of the recording head.

Japanese Patent Application Publication No. 2006-281588 (JP2006-281588) discloses an ink cartridge including an ink bag and an ink outlet having a check valve for preventing the flow of external air and dust into the ink bag.

Also, Japanese Patent Application Publication No. 2008-134591 (JP2008-134591) discloses a configuration where reinforcing parts are provided for a flexible container to prevent uneven deformation of two opposing sides of the flexible container and to keep the two opposing sides parallel to each other.

As described above, the configuration disclosed in JP2006-327111 makes it possible to prevent remaining ink in a flexible container from becoming unusable and to relatively accurately detect the amount of remaining ink in the flexible container based on the capacitance between electrodes. However, with the disclosed configuration, it is not possible to prevent external air and dust from entering the flexible container via the ink outlet.

The configuration disclosed in Japanese Patent Application Publication No. 2006-281588 makes it possible to prevent external air and dust from entering a flexible container. However, with the disclosed configuration, it is difficult to prevent remaining ink in the flexible container from becoming unusable and to accurately detect the amount of remaining ink in the flexible container.

Meanwhile, employing both of the configurations disclosed in JP2006-327111 and JP2006-281588 increases the number of components of an ink cartridge and thereby increases the production costs of the ink cartridge.

SUMMARY OF THE INVENTION

In an aspect of this disclosure, there is provided an ink cartridge for an image forming apparatus including an inkjet head for jetting ink from nozzles. The ink cartridge includes a flexible container containing ink; and a restriction mechanism allowing the flexible container to deform only in the direction to decrease the volume of the flexible container.

DESCRIPTION OF THE PREFERRED EMBODIMENTS

Preferred embodiments of the present invention are described below with reference to the accompanying drawings.

An ink cartridge according to an embodiment of the present invention includes a restriction mechanism that allows a flexible container to deform only in the direction to decrease the volume of the flexible container. In other words, the restriction mechanism prevents increase in the volume of the flexible container and thereby prevents generation of negative pressure in the flexible container. This in turn makes it possible to prevent external air and dust from entering the flexible container through an ink outlet.

According to another embodiment of the present invention, the restriction mechanism includes a deformation restricting part for restricting deformation of the flexible container and a movement restricting part for restricting the deformation restricting part from opening. This configuration makes it possible to prevent increase in the volume of the flexible container and thereby prevents external air and dust from entering the flexible container through the ink outlet.

Figure 1:
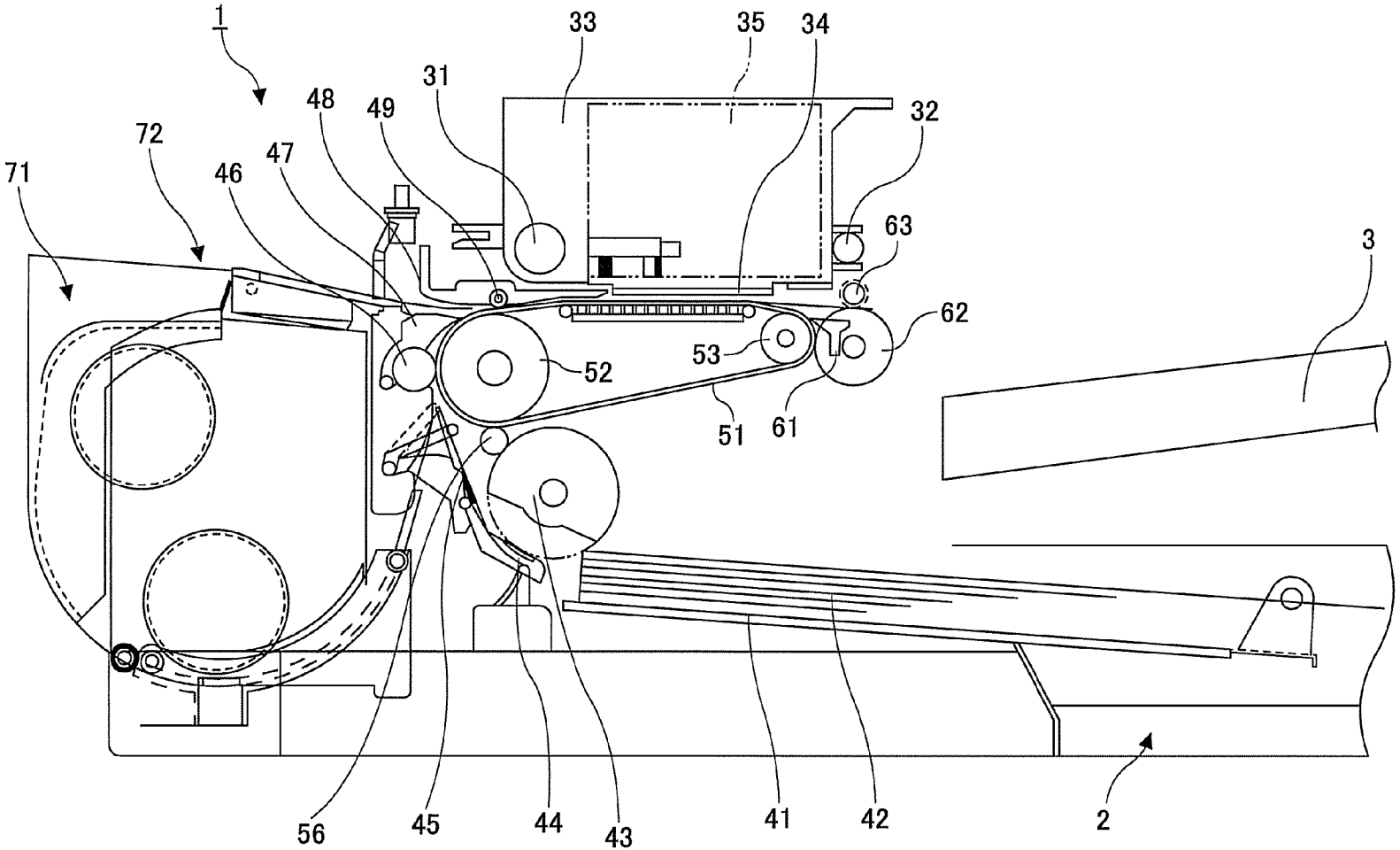
FIG. 1 is a side view of an image forming apparatus according to an embodiment of the present invention.

An exemplary image forming apparatus according to an embodiment of the present invention is described below with reference to FIGS. 1 and 2. FIG. 1 is a side view of the image forming apparatus; and FIG. 2 is a plan view of the image forming apparatus.

Figure 2:
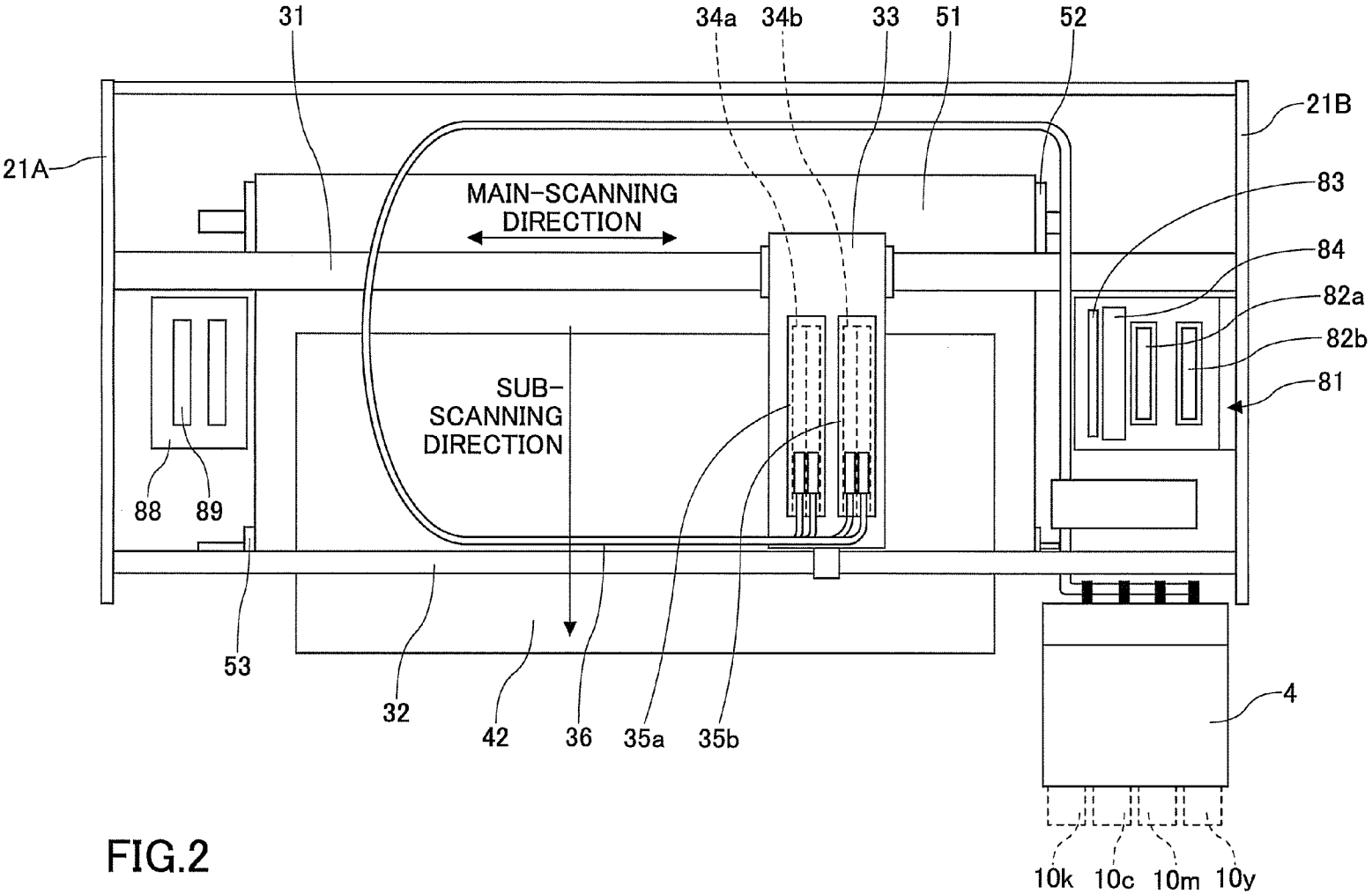
FIG. 2 is a plan view of an image forming apparatus according to an embodiment of the present invention.

The image forming apparatus of this embodiment is a serial image forming apparatus and includes a body 1, guide rods 31 and 32 extended laterally between right and left side boards 21A and 21B of the body 1, and a carriage 33 supported by the guide rods 31 and 32 so as to be slidable in the main-scanning direction indicated by arrows in FIG. 2. The carriage 33 is moved in the main-scanning direction via a timing belt by a main-scanning motor (not shown).

Recording heads 34*a* and 34*b* (may be collectively called the recording heads 34 or the recording head 34 when distinction is not necessary), which are liquid-jet heads (inkjet heads) for jetting ink droplets of yellow (Y), cyan (C), magenta (M), and black (K), are mounted on the carriage 33. The recording heads 34 include arrays of nozzles (hereafter called nozzle arrays) and are mounted on the carriage 33 such that each nozzle array is arranged in the sub-scanning direction that is orthogonal to the main-scanning direction and ink droplets are jetted downward.

Each of the recording heads 34 includes two nozzle arrays. One of the nozzle arrays of the recording head 34*a* jet black (K) ink droplets and the other one of the nozzle arrays of the recording head 34*a* jet cyan (C) ink droplets. Meanwhile, one of the nozzle arrays of the recording head 34*b* jet magenta (M) ink droplets and the other one of the nozzle arrays of the recording head 34*b* jet yellow (Y) ink droplets.

Sub tanks 35*a* and 35*b* (may be collectively called the sub tanks 35 or the sub tank 35 when distinction is not necessary) used as secondary liquid containers are also mounted on the carriage 33. The sub tanks 35*a* and 35*b* supply inks of the corresponding colors to the nozzle arrays of the recording heads 34. Ink cartridges 10*y*, 10*m*, 10*c*, and 10*k* (may be collectively called the ink cartridges 10 or the ink cartridge 10 when distinction is not necessary) used as primary liquid containers are detachably attached to a cartridge holder 4. The ink cartridges 10 supply inks of the corresponding colors via supply tubes 36 to the sub tanks 35.

The image forming apparatus also includes a paper feeding unit for feeding paper sheets 42 stacked on a paper stacking plate (pressing plate) 41 of a paper feed tray 2. The paper feeding unit includes a crescent roller (paper feed roller) 43 for separating and feeding the paper sheets 42 one by one from the paper stacking plate 41, and a separating pad 44 facing the paper feed roller 43 and made of a material with a high friction coefficient. The separating pad 44 is biased toward the paper feed roller 43.

The image forming apparatus also includes a guide part 45 for guiding the paper sheet 42, a counter roller 46, a conveying guide part 47, and a holding part 48 including an edge pressing roller 49. These components feed the paper sheet 42 fed from the paper feeding unit into a position below the recording heads 34. A conveyor belt 51 attracts the paper sheet 42 by electrostatic attraction and further conveys the paper sheet 42 under the recording heads 34.

The conveyor belt 51 is an endless belt stretched between a conveying roller 52 and a tension roller 53 and rotates in the sub-scanning direction (belt conveying direction). A charging roller 56 charges the surface of the conveyor belt 51. The charging roller 56 is in contact with the surface layer of the conveyor belt 51 and is rotated by the rotation of the conveyor belt 51. The conveying roller 52 is rotated via a timing belt by a sub-scanning motor (not shown) and the conveying roller 52 in turn rotates the conveyor belt 51 in the belt conveying direction shown in FIG. 2.

The image forming apparatus further includes a paper ejecting unit for ejecting the paper sheet 42 on which an image has been recorded by the recording heads 34. The paper ejecting unit includes a separating claw 61 for separating the paper sheet 42 from the conveyor belt 51, a paper ejecting roller 62, and a spur (paper ejecting roller) 63. A paper catch tray 3 is disposed below the paper ejecting roller 62.

A duplex unit 71 is detachably attached to the back of the body 1. The duplex unit 61 takes in the paper sheet 42 conveyed backward by the reverse rotation of the conveyor belt 51, reverses the paper sheet 42, and feeds the paper sheet 42 again into the space between the counter roller 46 and the conveyor belt 51. The upper surface of the duplex unit 61 is used as a manual-feed tray 72.

Also, as shown in FIG. 2, a maintenance/cleaning mechanism 81 is provided in a non-image-forming area to the right of the carriage 33. The maintenance/cleaning mechanism 81 maintains and cleans the nozzles of the recording heads 34. The maintenance/cleaning mechanism 81 includes caps 82*a* and 82*b* (may be called the caps 82 when distinction is not necessary) for covering the nozzle surfaces of the recording heads 34, a wiper blade 83 for wiping the nozzle surfaces, and a waste-ink receiver 84 for receiving ink droplets that are jetted not to record an image but to purge dried (or thickened) ink from the nozzles.

Also, a waste-ink receiver 88 is provided in a non-image-forming area to the left of the carriage 33. The waste-ink receiver 88 receives ink droplets that are jetted not to record an image but to purge dried ink from the nozzles during a recording process. The waste-ink receiver 88 has openings 89 extending in a direction in which the nozzles of the recording heads 34 are arranged.

In the image forming apparatus configured as described above, the paper sheets 42 are separated and fed one by one from the paper feed tray 2, and the separated paper sheet 42 is fed approximately vertically upward and guided by the guide part 45 into the space between the conveyor belt 51 and the counter roller 46 so as to be conveyed further. The leading edge of the paper sheet 42 is then guided by the conveying guide part 47 and pressed by the edge pressing roller 49 onto the conveyor belt 51, and the direction of the paper sheet 42 is thereby changed approximately 90 degrees.

Positive and negative voltages are alternately applied to the charging roller 56 (i.e., an alternating voltage is applied to the charging roller 56). As a result, positively and negatively charged bands with a constant width are formed alternately in the belt conveying direction (the sub-scanning direction) on the surface of the conveyor belt 51. When the paper sheet 42 is conveyed onto the alternately-charged conveyor belt 51, the paper sheet 42 is attracted to the conveyor belt 51 and is conveyed in the sub-scanning direction along with the rotation of the conveyor belt 51.

The recording heads 34 are driven according to an image signal while moving the carriage 33. The recording heads 34 jet ink droplets onto the paper sheet 42 while it is stationary and thereby record a line of image. Then, the paper 42 is conveyed a predetermined distance, and the next line is recorded. When a recording completion signal or a signal indicating that the rear edge of the paper sheet 42 has reached the image forming area is received, the recording process is terminated and the paper sheet 42 is ejected onto the paper catch tray 3.

Figure 3:
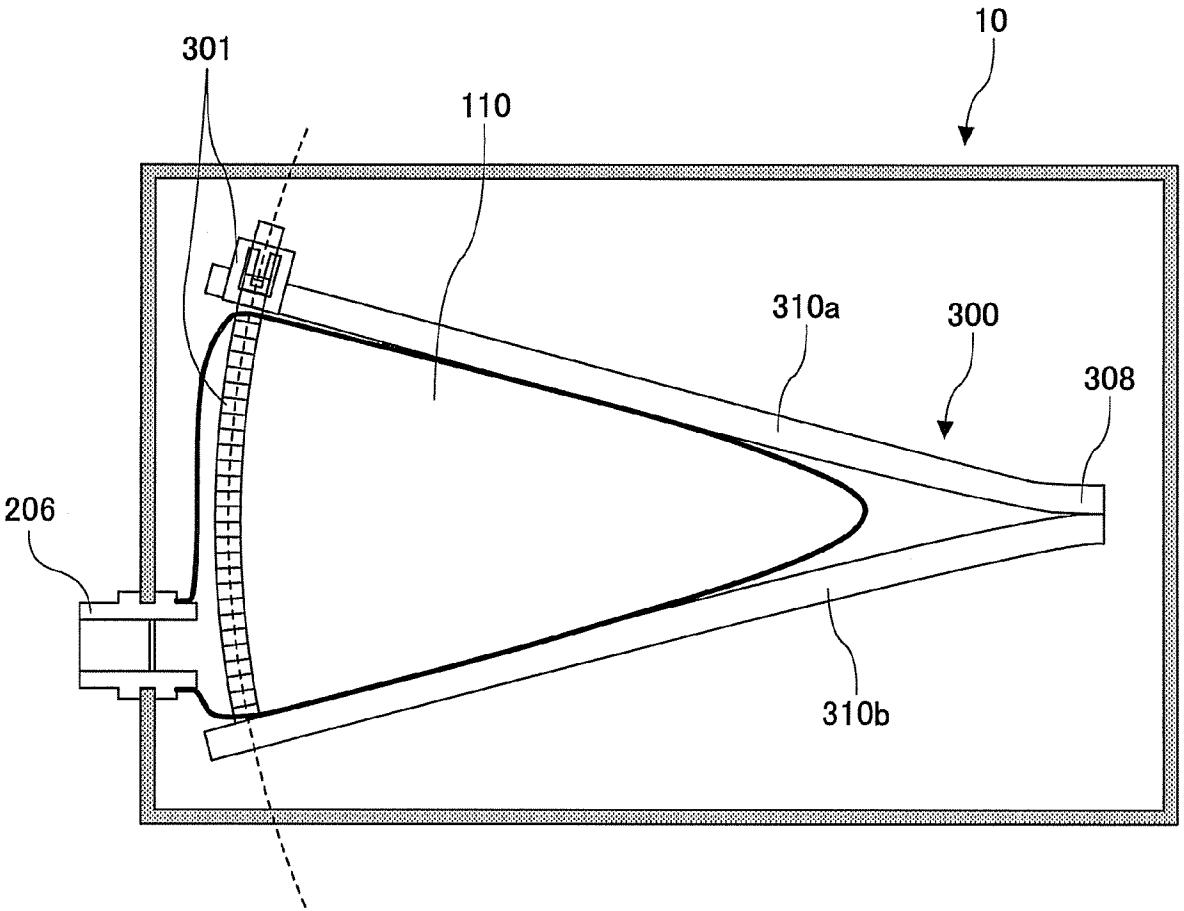
FIG. 3 is a drawing illustrating an ink cartridge according to an embodiment of the present invention.
Figure 4:
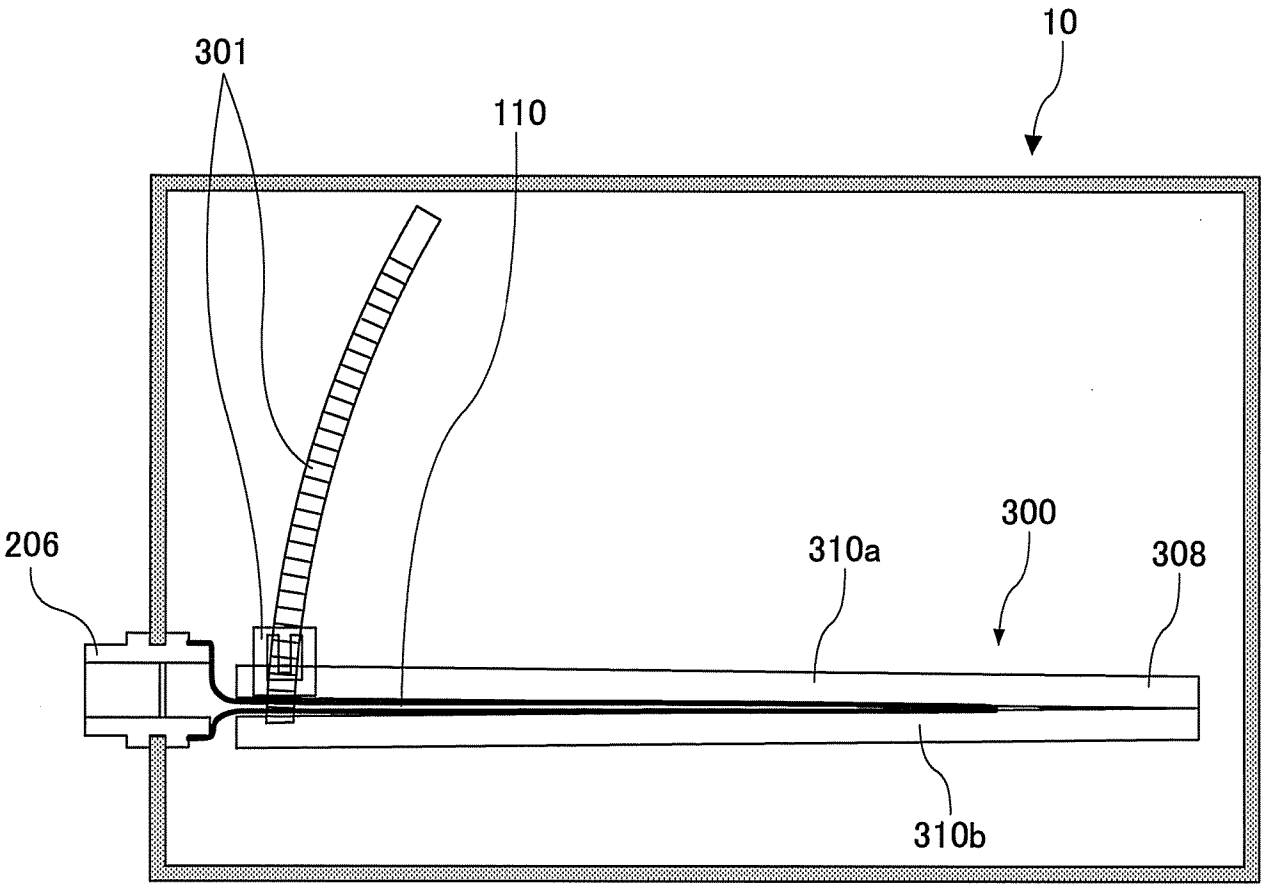
FIG. 4 is another drawing illustrating an ink cartridge according to an embodiment of the present invention.

An ink cartridge 10 of this embodiment is described with reference to FIGS. 3, 4, 5A, and 5B. FIG. 3 is a drawing illustrating the ink cartridge 10. FIG. 4 is another drawing illustrating the ink cartridge 10.

As shown in FIG. 3, the ink cartridge 10 includes a flexible container 110 for containing ink, an ink outlet 206 for drawing ink from the flexible container 110, a deformation restricting part 300 for restricting deformation of the flexible container 110, and a movement restricting part 301 for restricting the movement of the deformation restricting part 300.

An ink supply needle 205 (see FIG. 8) provided in the cartridge holder 4 (see FIG. 2) is inserted into the ink outlet 206 to draw ink from the flexible container 110. The ink supply needle 205 and the ink outlet 206 constitute a connecting unit 207 (see FIG. 8). The deformation restricting part 300 includes a first plate 310*a* and a second plate 310*b* that are joined at a joint 308. The first plate 310*a* and the second plate 310*b* may be made of an elastic material. The first plate 310*a* and the second plate 310*b* may be bonded, fused, or joined with a hinge at the joint 308.

The deformation restricting part 300 "closes" when the first plate 310*a* moves closer to the second plate 310*b* and "opens" when the first plate 310*a* moves away from the second plate 310*b*.

Figure 5B:
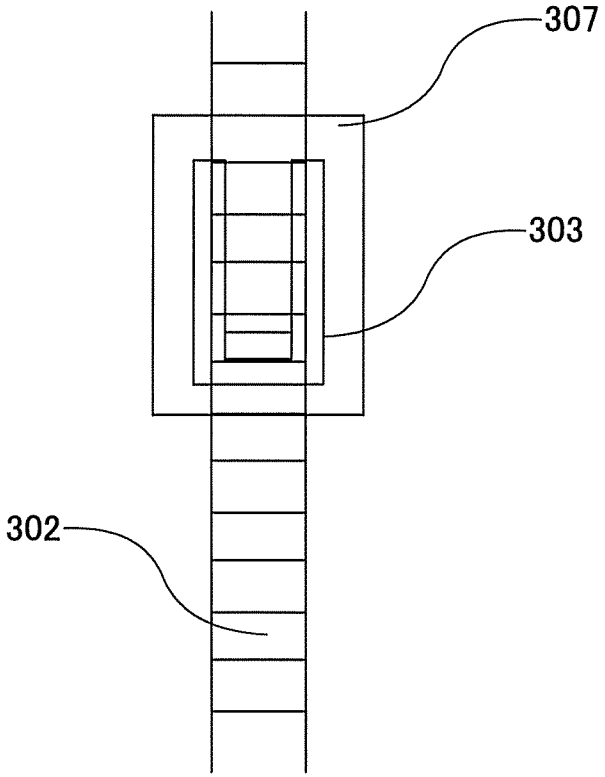
FIGS. 5A and 5B are drawings illustrating a configuration of a movement restricting part according to an embodiment of the present invention.
Figure 5A:
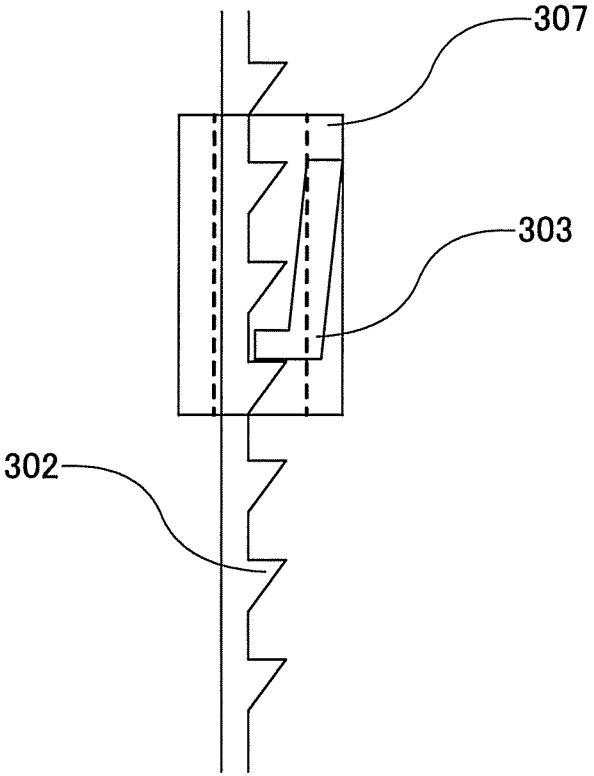

FIGS. 5A and 5B are drawings illustrating a configuration of the movement restricting part 301. As shown in FIGS. 5A and 5B, the movement restricting part 301 includes a band 302 and a guide part 307. The band 302 extends from one end of the second plate 310*b* of the deformation restricting part 300. One end of the band 302 is attached to the end of the second plate 310*b*. Protrusions (hereafter called triangular protrusions) shaped like right-angle triangles in the side view (or shaped like triangular prisms) are formed on one side of the band 302. The guide part 307 is attached to one end of the first plate 310*a* of the deformation restricting part 300. The band 302 passes through the guide part 307 such that the guide part 307 can move along the band 302. The guide part 307 includes a locking part 303. The locking part 303 engages with the vertical side of each triangular protrusion of the band 302 and thereby prevents the guide part 307 (or the first plate 310*a*) from moving in the direction to open the deformation restricting part 300.

Meanwhile, when the first plate 310*a* moves in the direction to close the deformation restricting part 300, the locking part 303 is pushed upward by the triangular protrusion of the band 302 and climbs up the slope of the triangular protrusion. Therefore, the guide part 307 (or the first plate 310*a*) can move smoothly in the direction to close the deformation restricting part 300. Alternatively, the deformation restricting part 300 and the movement restricting part 301 may be configured such that the first plate 310*a* and the second plate 310*b* move toward each other to close the deformation restricting part 300.

The band 302 of the movement restricting part 301 is preferably shaped like and disposed so as to form an arc of a circle centered at the joint 308 of the deformation restricting part 300. As shown in FIG. 4, with the arc-shaped band 302, the angle between the first plate 310*a* of the deformation restricting part 300 and the band 302 is maintained even when the ink in the flexible container 110 is consumed and the first plate 310*a* moves toward the second plate 310*b*. In other words, this configuration makes it possible to make the direction of movement of the first plate 310*a* or the guide part 307 match the direction in which the band 302 extends (i.e., prevents inclination of the moving direction of the first plate 310*a* from the extending direction of the band 302). This in turn makes it possible to prevent the guide part 307 from becoming stuck in the middle of the band 302.

With the above configuration, the movement restricting part 301 allows the first plate 310*a* of the deformation restricting part 300 to move only in the direction to close the deformation restricting part 300.

In other words, the movement restricting part 301 prevents the deformation restricting part 300 from opening and thereby prevents the volume of the flexible container 110 from increasing. This in turn makes it possible to prevent external air and dust from flowing into the flexible container 110 and contaminating ink in the flexible container 110.

Thus, the above embodiment provides a restriction mechanism that includes the deformation restricting part 300 and the movement restricting part 301 and allows the flexible container 110 to deform only in the direction to decrease the volume of the flexible container 110.

Also, the above embodiment makes it possible to provide a simple restriction mechanism for restricting deformation of a flexible container to one direction with a relatively small number of parts.

However, the configuration of a restriction mechanism for restricting deformation of the flexible container 110 is not limited to the above embodiment. For example, a restriction mechanism may include a syringe and a piston or a roller for flattening the flexible container 110. In other words, a restriction mechanism may include components different from the deformation restricting part 300 and the movement restricting part 301 as long as it can restrict deformation of the flexible container 110 such that the volume of the flexible container 110 is not increased.

Next, a variation of the deformation restricting part 300 is described with reference to FIG. 6.

Figure 6:
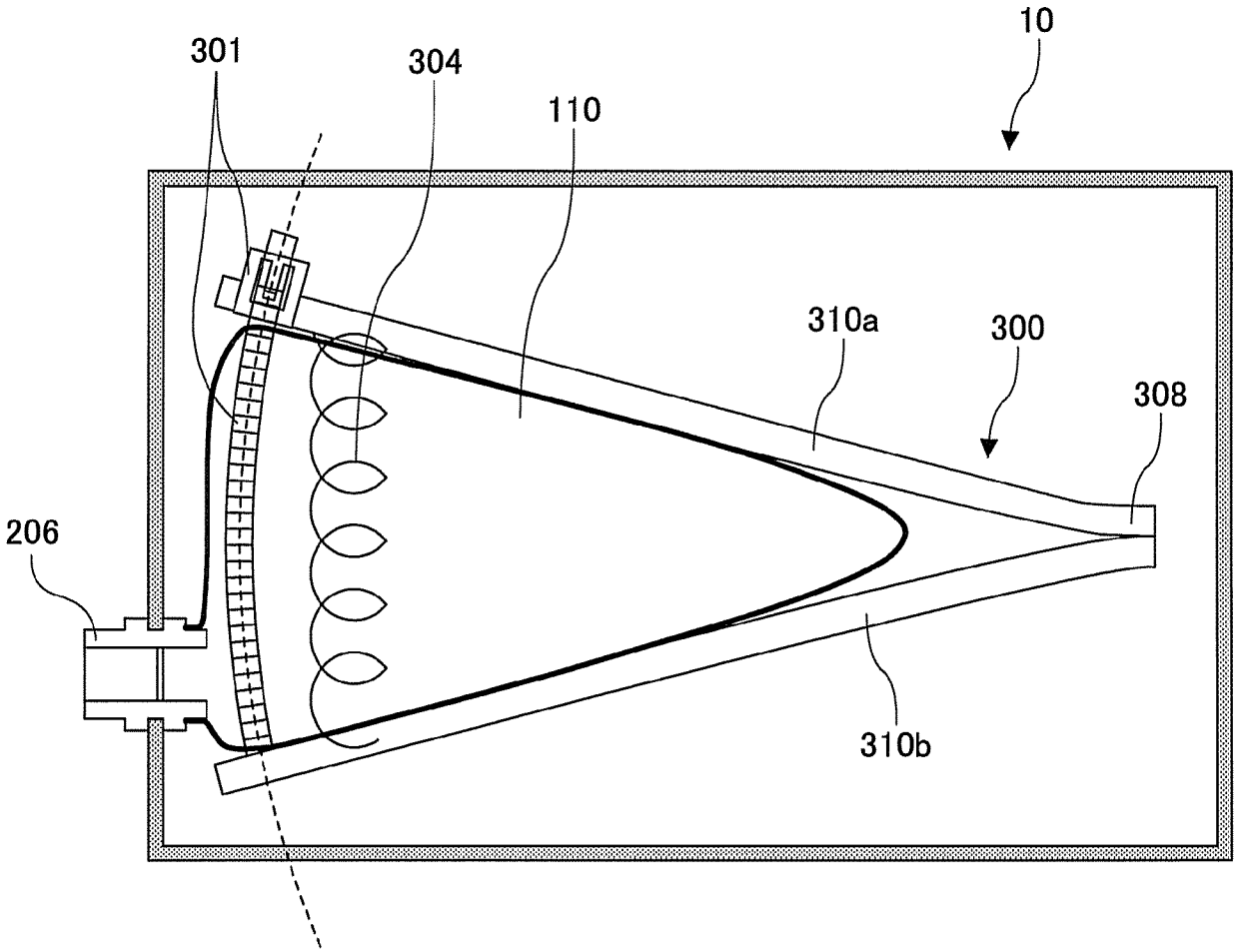
FIG. 6 is a drawing illustrating a variation of a deformation restricting part according to an embodiment of the present invention.

The deformation restricting part 300 shown in FIG. 6 further includes a biasing part 304 that is an elastic part such as a spring. The biasing part 304 biases the first plate 310*a* toward or away from the second plate 310*b*. This bias, in combination with the elasticity of the deformation restricting part 300, causes the first plate 310*a* to apply force to the flexible container 110 and thereby to generate positive or negative pressure in the flexible container 110. Also, with the biasing part 304, it is possible to generate positive or negative pressure in the flexible container 110 even when the first plate 310*a* and the second plate 310*b* are joined at the joint 308 using a hinge and the first plate 310*a* does not move by itself to apply force to the flexible container 110.

Alternatively, the first plate 310*a* (and/or the second plate 310*b*) of the deformation restricting part 300 may be bent or pulled beforehand to cause internal stress so that the first plate 310*a* returns from the position shown in FIG. 3 to the position (original position) shown in FIG. 4. With this configuration, when the flexible container 110 is filled with ink and the deformation restricting part 300 is open, the first plate 310*a* tries to return to the original position or shape and to close the deformation restricting part 300. Thus, this configuration makes it possible to generate positive pressure in the flexible container 110 without using the biasing part 304.

As another configuration, the deformation restricting part 300 may be configured such that no internal stress is caused in the first plate 310*a* at the position shown in FIG. 3. With this configuration, when the ink in the flexible container 110 is consumed and the deformation restricting part 300 is closed, the first plate 310*a* tries to move in the direction to open the deformation restricting part 300. Thus, this configuration makes it possible to generate negative pressure in the flexible container 110 without using the biasing part 304.

Figure 7:
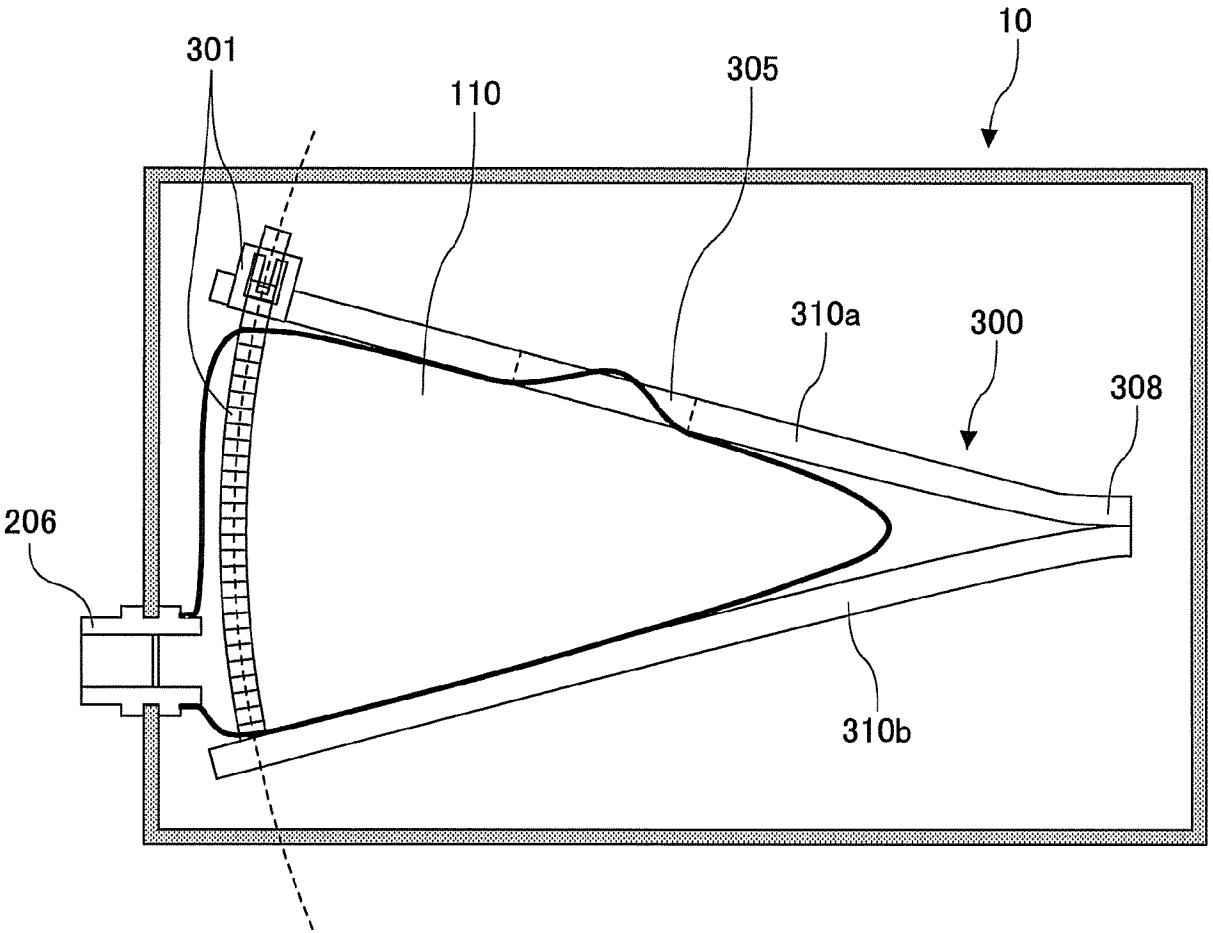
FIG. 7 is a drawing illustrating another variation of a deformation restricting part according to an embodiment of the present invention.
Figure 8:
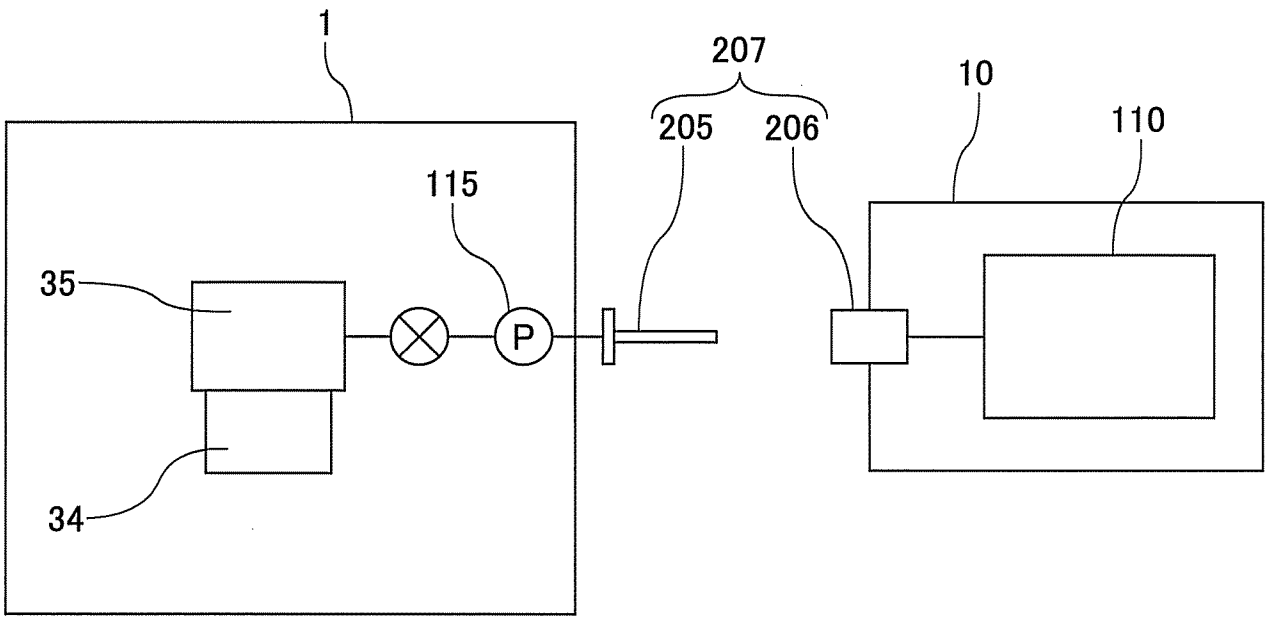
FIG. 8 is a schematic diagram of an image forming apparatus according to an embodiment of the present invention.

Next, another variation of the deformation restricting part 300 is described with reference to FIGS. 7 and 8. FIG. 7 is a drawing illustrating a variation of the deformation restricting part 300. FIG. 8 is a schematic diagram of the image forming apparatus of this embodiment.

With a typical inkjet recording head, it is necessary to generate negative pressure in the recording head to prevent ink from flowing out of nozzle openings of the recording head. In one method, ink is suctioned from the nozzle openings and discarded to generate negative pressure in the recording head. For an image forming apparatus employing this method, an ink cartridge of the above embodiment may be used without change. However, with this method, the ink suctioned from the nozzle openings to generate negative pressure is wasted. To solve this problem, another method has been proposed. In the proposed method, a pump 115 (see FIG. 8) for supplying ink to the recording head 34 is driven in a reverse direction to return ink from the recording head 34 to the ink cartridge 10 and thereby to generate negative pressure in the recording head 34.

Here, if such a mechanism to return ink from the recording head 34 to the ink cartridge 10 is used together with the movement restricting part 301 of the above embodiment, the ink returned from the recording head 34 abnormally increases the pressure in the flexible container 110 of the ink cartridge 10. The abnormal increase of the pressure in the flexible container 110, in turn, may cause the ink to leak from the flexible container 110 or may damage the flexible container 110.

To prevent this problem, as shown in FIG. 7, a hole 305 may be formed in the first plate 310*a* of the deformation restricting part 300. This configuration allows the flexible container 110 to expand through the hole 305 and thereby makes it possible to prevent drastic increase of the pressure in the flexible container 110.

Figure 9:
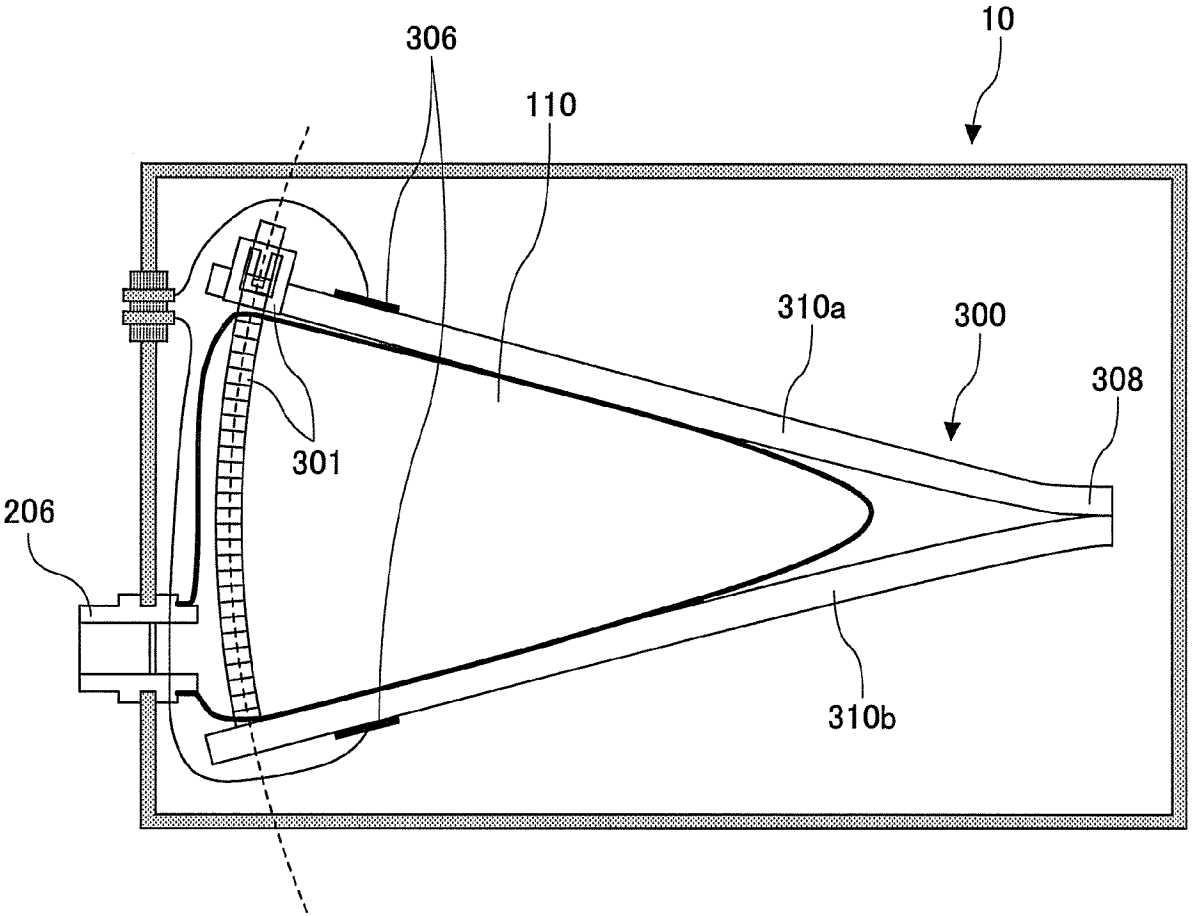
FIG. 9 is a drawing illustrating an ink cartridge according to an embodiment of the present invention.

A still another configuration of the ink cartridge 10 is described with reference to FIG. 9. The ink cartridge 10 shown in FIG. 9 further includes a pair of electrodes 306 used as an ink-amount detecting part. The electrodes 306 are attached to the first plate 310*a* and the second plate 310*b* of the deformation restricting part 300 or to the flexible container 110. The image forming apparatus measures the capacitance between the electrodes 306 and thereby measures the distance between the electrodes 306.

Since the flexible container 110 of this embodiment deforms along with the movement of the first plate 310*a* of the deformation restricting part 300, it is possible to determine the volume of the flexible container 110 based on the measured distance between the electrodes 306 and to determine the amount of remaining ink based on the determined volume of the flexible container.

Also, since the deformation of the flexible container 110 is restricted by the deformation restricting part 300, it is possible to prevent wrong detection of the amount of remaining ink due to uneven deformation of the flexible container 110.

As the amount of ink decreases and the flexible container 110 flattens, the first plate 301*a* moves closer to the second plate 310*b* and finally becomes substantially parallel to the second plate 310*b*. Therefore, the accuracy of detecting the distance between the electrodes 306 based on the capacitance improves as the amount of ink decreases. In other words, the accuracy of detecting the amount of remaining ink improves as it becomes closer to the timing of replacing the ink cartridge.

As described above, the ink cartridge 10 of the above embodiments includes a restriction mechanism that allows the flexible container 110 to deform only in the direction to decrease the volume of the flexible container. This configuration prevents increase in the volume of the flexible container 110 and thereby prevents generation of negative pressure in the flexible container 110. This in turn makes it possible to prevent external air and dust from flowing into the flexible container 110 through the ink outlet 206 and contaminating ink in the flexible container 110. The restriction mechanism includes the deformation restricting part 300 and the movement restricting part 301. The deformation restricting part 300 restricts deformation of the flexible container 110 and includes the first plate 310*a* and the second plate 310*b*. The movement restriction part 301 prevents the deformation restricting part 300 from opening. This configuration prevents increase in the volume of the flexible container 110 and thereby makes it possible to prevent external air and dust from flowing into the flexible container 110 through the ink outlet 206. The movement restricting part 301 includes the band 302 and the guide part 307. The band 302 is shaped like an arc of a circle centered at the joint 308 of the deformation restricting part 300. With the arc-shaped band 302, the angle between the first plate 310*a* and the band 302 is maintained even when the first plate 310*a* moves toward the second plate 310*b*. This makes it possible to prevent the guide part 307 from becoming stuck in the middle of the band 302.

The deformation restricting part 300 may further include the biasing part 304 for biasing the first plate 310*a* toward or away from the second plate 310*b*. This bias causes the first plate 310*a* to apply force to the flexible container 110 and thereby to generate positive or negative pressure in the flexible container 110. The positive pressure causes ink in the flexible container to be supplied to the recording head 34 and thereby makes it possible to stably form an image. Meanwhile, the negative pressure prevents ink from flowing out of the nozzle openings of the recording head 34. As an alternative configuration, the first plate 310*a* of the deformation restricting part 300 may be configured to return to the original position by elasticity and thereby to apply force to the flexible container. This configuration makes it possible to generate positive or negative pressure in the flexible container 110 without using the biasing part 304 and thereby to reduce the production costs.

Also, the hole 305 may be formed in the first plate 310*a*. This configuration allows the flexible container 110 to expand through the hole 305 and thereby makes it possible to prevent drastic increase of the pressure in the flexible container 110 when ink is returned from the recording head 34 and the sub tank 35 to the ink cartridge 10 to generate negative pressure in the recording head 34. Further, an ink-amount detecting part for detecting the amount of remaining ink in the flexible container 110 may be attached to the deformation restricting part 300 or the flexible container 110. The ink-amount detecting part makes it possible to report the amount of remaining ink and the timing of replacing the ink cartridge 10 to the user.

The ink-amount detecting part may include a pair of metal plates and the amount of remaining ink may be detected based on the capacitance between the metal plates. This configuration makes it possible to accurately detect the amount of remaining ink with a simple detecting unit and to reduce the risk of reporting an incorrect amount of remaining ink to the user.

The present invention is not limited to the specifically disclosed embodiments, and variations and modifications may be made without departing from the scope of the present invention.

The present application is based on Japanese Priority Application No. 2009-211357, filed on Sep. 14, 2009, the entire contents of which are hereby incorporated herein by reference.

What is claimed is:

1. An ink cartridge for an image forming apparatus including an inkjet head for jetting ink from nozzles, the ink cartridge comprising:

a flexible container containing ink; and a restriction mechanism allowing the flexible container to deform only in a direction to decrease a volume of the flexible container, wherein the restriction mechanism includes a deformation restricting part including a first plate and a second plate and restricting deformation of the flexible container; and a movement restricting part allowing the first plate of the deformation restricting part to move only in one direction.

2. The ink cartridge as claimed in claim 1, wherein the movement restricting part is shaped like and disposed so as to form an arc of a circle centered at a joint of the first plate and the second plate of the deformation restricting part.

3. The ink cartridge as claimed in claim 1, wherein the first plate of the deformation restricting part is biased in a direction to generate positive or negative pressure in the flexible container.

4. The ink cartridge as claimed in claim 3, wherein the first plate of the deformation restricting part is biased by its own elasticity in the direction to generate positive or negative pressure in the flexible container.

5. The ink cartridge as claimed in claim 3, wherein the deformation restricting part further includes an elastic part and the first plate is biased by the elastic part in the direction to generate positive or negative pressure in the flexible container.

6. The ink cartridge as claimed in claim 1, wherein a hole is formed in the first plate of the deformation restricting part.

7. The ink cartridge as claimed in claim 1, further comprising:

an ink-amount detecting part attached to the deformation restricting part or the flexible container and used by the image forming apparatus to detect an amount of remaining ink in the flexible container.

8. The ink cartridge as claimed in claim 7, wherein the ink-amount detecting part includes a pair of metal plates; and the amount of remaining ink in the flexible container is detected based on capacitance between the metal plates.

9. An image forming apparatus comprising the ink cartridge as claimed in claim 1.

* * * * *